US005176472A

United States Patent [19]

Kinder

[11] Patent Number: 5,176,472

[45] Date of Patent: Jan. 5, 1993

[54] FOUNDATION SHORING METHOD AND MEANS

[76] Inventor: William D. Kinder, 3555 Middlefield Rd., #1, Dallas, Tex. 75253

[21] Appl. No.: 706,269

[22] Filed: May 28, 1991

Related U.S. Application Data

[60] Division of Ser. No. 316,090, Feb. 27, 1989, Pat. No. 5,018,905, which is a continuation-in-part of Ser. No. 807,840, Dec. 11, 1985, abandoned, and a continuation-in-part of Ser. No. 762,800, Aug. 2, 1985, abandoned, which is a continuation of Ser. No. 464,973, Feb. 8, 1983, abandoned.

[51] Int. Cl.[5] ..... E02D 17/02

[52] U.S. Cl. ..... 405/230; 405/232

[58] Field of Search ..... 405/229-233, 405/249-253, 256, 257; 52/126.1, 170, 726; 175/40, 50, 60, 46, 122, 162, 203, 170, 393, 409, 411, 417, 419, 420; 299/81

[56] References Cited

U.S. PATENT DOCUMENTS

| | | | |
|---|---|---|---|
| 1,203,860 | 11/1916 | Dunbar | 175/203 X |
| 1,263,802 | 4/1918 | Reed | 175/340 |
| 2,093,633 | 9/1937 | Catland | 175/254 |
| 2,673,714 | 3/1954 | Hargrave | 175/394 |
| 2,673,716 | 3/1954 | Avery | 175/410 |
| 2,741,910 | 4/1956 | Thornley | 52/126.1 |
| 2,982,103 | 5/1961 | Revesz et al. | 405/230 |
| 3,059,708 | 10/1962 | Cannon et al. | 175/393 |
| 3,094,175 | 6/1963 | Jackson | 175/69 |
| 3,333,430 | 8/1967 | Dougherty | 405/253 |
| 3,354,657 | 11/1967 | Turzillo | 405/244 |
| 3,502,543 | 3/1970 | Sewell | 175/162 X |
| 3,796,055 | 3/1974 | Mahony | 405/230 |
| 3,852,970 | 12/1974 | Cassidy | 405/230 |
| 3,902,326 | 9/1925 | Langenbach | 405/230 |
| 3,946,601 | 3/1976 | Yizhaki | 73/84 |
| 4,081,992 | 4/1978 | Aurora et al. | 73/84 |
| 4,118,135 | 10/1978 | Cooper | 403/361 |
| 4,156,469 | 5/1979 | Laskey | 175/58 |
| 4,254,597 | 3/1981 | Feldman et al. | 52/103 |
| 4,540,056 | 9/1985 | O'Hanlon | 175/393 |
| 4,563,110 | 1/1986 | Langenbach et al. | 405/230 |
| 4,673,315 | 6/1987 | Shaw et al. | 405/230 |
| 4,678,373 | 7/1987 | Langenbach | 405/230 |
| 4,708,528 | 11/1987 | Rippe | 405/230 |

FOREIGN PATENT DOCUMENTS

| | | | |
|---|---|---|---|
| 2938564 | 4/1981 | Fed. Rep. of Germany | 175/203 |
| 2164374 | 3/1986 | United Kingdom | 175/203 |

OTHER PUBLICATIONS

Petroleum Engineering, Carl Gatlin, 1960, p. 197.

*Primary Examiner*—Randolph A. Reese
*Assistant Examiner*—John Ricci
*Attorney, Agent, or Firm*—Crutsinger & Booth

[57] ABSTRACT

Apparatus for shoring a building foundation including spaced pilings extending into drilled bore holes such that the lower ends of the pilings rest on and are supported by a sub-stratum believed capable of supporting a portion of the weight of the foundation. Each of a plurality of pressure actuated jacks is connectable between a support bracket and one of the spaced pilings. The jacks are used to individually load test each of the pilings by application of force exceeding the portion of the weight of the foundation which will be supported by each individual piling. Load equalizing manifolds are connected to the fluid inlets and to the fluid outlets of the jacks to distribute a portion of the weight of the foundation over the pilings.

8 Claims, 10 Drawing Sheets

FOUNDATION SHORING METHOD AND MEANS

This is a division of Ser. No. 07/316,090, filed Feb. 27, 1989, now U.S. Pat. No. 5,018,905, which is a continuation-in-part of Ser. No. 06/807,840, filed Dec. 11, 1985, now abandoned, and a continuation-in-part of Ser. No. 06/762,800, filed Aug. 2, 1985, now abandoned, which is a continuation of Ser. No. 06/464,973, filed Feb. 8, 1983, now abandoned.

TECHNICAL FIELD

The invention pertains to a method and apparatus for shoring a building foundation and more particularly to a method and apparatus which uses a piling in a bore drilled in the earth adjacent the building foundation.

BACKGROUND OF THE INVENTION

Heretofore piers have been forced into the ground by jacks or by hammering for shoring a building foundation. Piles or piers have been driven into the ground until the pier could not be driven further with the driving equipment available at the job site. When the pier could not be driven further into the ground, it was assumed that the pier had been driven to bed rock and was sufficiently supported. However, it has been found that driven piers often are not supported by bed rock and that the foundation settles as a result of contraction and expansion of the soil formation in which the piling has been driven.

Further, changes in moisture content results in expansion of the soil which imposes forces longitudinally of the driven pier exerting uplift force through piers. Nonuniform uplift forces applied to portions of a slab or foundation often crack or damage the structure.

Rotary drilling equipment has been used heretofore for drilling wells for production of water, oil and gas. In well drilling operations core samples and chips are inspected by geologists to determine the general nature of the formation in which the well is being drilled. After the well is completed, the casing and tubing are supported by hangers at the well head.

There are several known methods and apparatus for shoring a building foundation in which a piling received within a bore adjacent the foundation provides support for the foundation. One such method and apparatus, disclosed in applicant's co-pending application Ser. No. 762,800, discloses a method and apparatus for shoring a building foundation in which a bore hole is drilled adjacent the foundation. Thereafter, a casing or pipe is lowered into the bore and a fitting, adapted for sliding along the pipe, is received thereover. The fitting is urged against a downwardly-directed portion of the foundation by a hydraulic ram until the foundation is lifted a selected amount. The fitting is secured to the pipe which is cut off below ground level and the fitting and upper portion of the pipe are covered with earth.

The disclosure in the co-pending application provides a method and apparatus for shoring a building foundation which usually includes a very stable support for the shored foundation. The piling is received in the bore which is drilled until bedrock is reached thereby permitting shoring of heavy loads on each piling and assuring that once shored, there will not be additional shifting of the foundation. Moreover, the method and apparatus disclosed in the copending application does not involve pouring concrete and is relatively inexpensive.

Although the above-described method and apparatus represents a substantial improvement over the prior art, the method and apparatus disclosed in the copending application suffers from several disadvantages. In some instances it may be necessary to drill as deep as 40–50 feet or deeper to reach a rock formation which is sufficiently stable to support the lower end of a piling after the weight of the foundation is transferred to the piling. Obtaining and transporting pipe of such length is awkward and costly. In addition, removal of the drill bit and pipe string used to drill the bore and insertion of the casing pipe therein requires more time than if the pipe string having the drill bit mounted thereon could be left in the bore and used as the piling. However, due to the expense of the commercially available bits used to drill the bore, such is not practical. Another disadvantage associated with the past method and apparatus is the wear sustained by the drill bit after a period of use.

Geographical formations vary widely throughout the United States. For example, in certain areas in central Oklahoma, the bed rock is relatively flat. When it has been determined by inspection of chips circulated to the surface of the drilled bore hole that the shaft has reached bed rock, it can be assumed that other piers supporting the same foundation will require drilling to approximately the same depth. However, in certain areas in north Texas the layer of bed rock is not flat or of uniform thickness and the depth of bore holes for piers supporting a single foundation may vary significantly.

It is a more specific object of the instant invention to provide such a method and apparatus in which the drill bit and pipe string used to drill the bore adjacent the foundation may be used as a piling for shoring the foundation.

SUMMARY OF THE INVENTION

The novel invention contemplates a novel method and means for shoring a building foundation which has been particularly designed and constructed for overcoming the foregoing disadvantages. The novel method comprises the initial step of positioning suitable core drilling equipment in the proximity of the building foundation whereby at least one, and usually a plurality of spaced bores may be drilled into the earth in the proximity of the building foundation. It may be preferably to dig a hole in the proximity of the foundation at the desired site for the bore drilling operation prior to the positioning of the drilling equipment. A bore hole is then drilled through the earth to the bedrock formation, this drilling operation being accomplished by a core drilling method wherein core samples are taken at various stages of the drilling operation in order to ascertain the exact formation through which the core drill is moving. When the core samples reveal that the core drill has reached the actual bedrock formation, the drilling operation may be ceased, and the drilling apparatus may be removed from the bore hole. A well casing may then be set in the bore hole in any well known manner with the lower end of the casing being disposed on or embedded within the actual bedrock formation. The well casing then becomes the piling means for support of the foundation, and suitable connecting means is utilized for securing the foundation to the outer periphery of the well casing. Of course, the core drilling may be repeated as many times around the outer peripheral areas of the foundation as required for an effective shoring of the foundation. The novel method and means is simple and efficient in operation and economical and durable in construction.

By load testing each individual pier to a safety factor in a range between two and four times the load which the pier is expected to support, it can be assured that each pier is supported by bed rock or a load supporting formation which is not susceptible to expansion or contraction regardless of the configuration of the layer of bed rock.

BRIEF DESCRIPTION OF THE DRAWINGS

Drawings of a preferred embodiment of the invention are annexed hereto so that the invention can be clearly understood.

DETAILED DESCRIPTION OF THE PREFERRED EMBODIMENT

Figure 1:
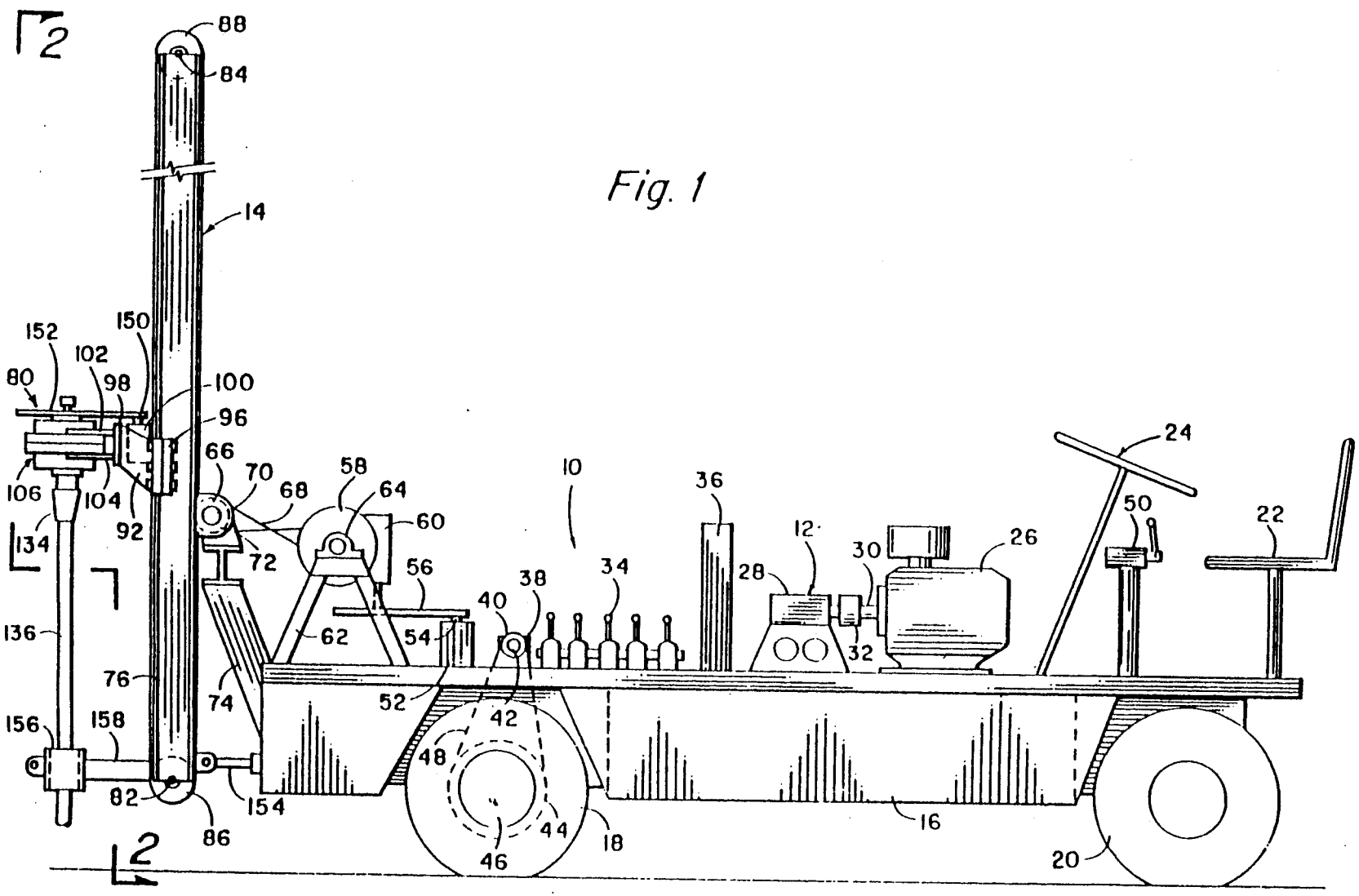
FIG. 1 is a side elevational view of a drilling apparatus embodying the invention and as utilized for facilitating the shoring of a building foundation.
Figure 2:
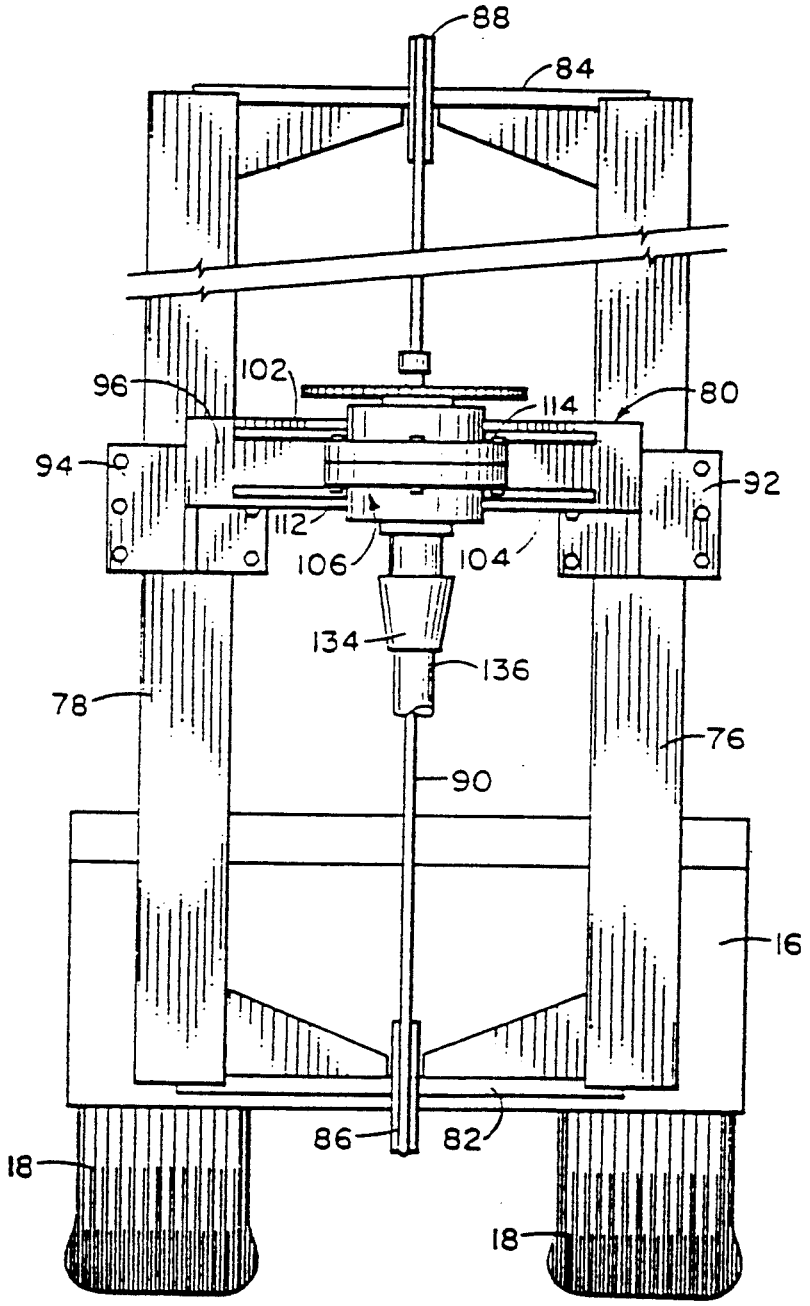
FIG. 2 is a view taken on line 2—2 of FIG. 1.
Figure 3:
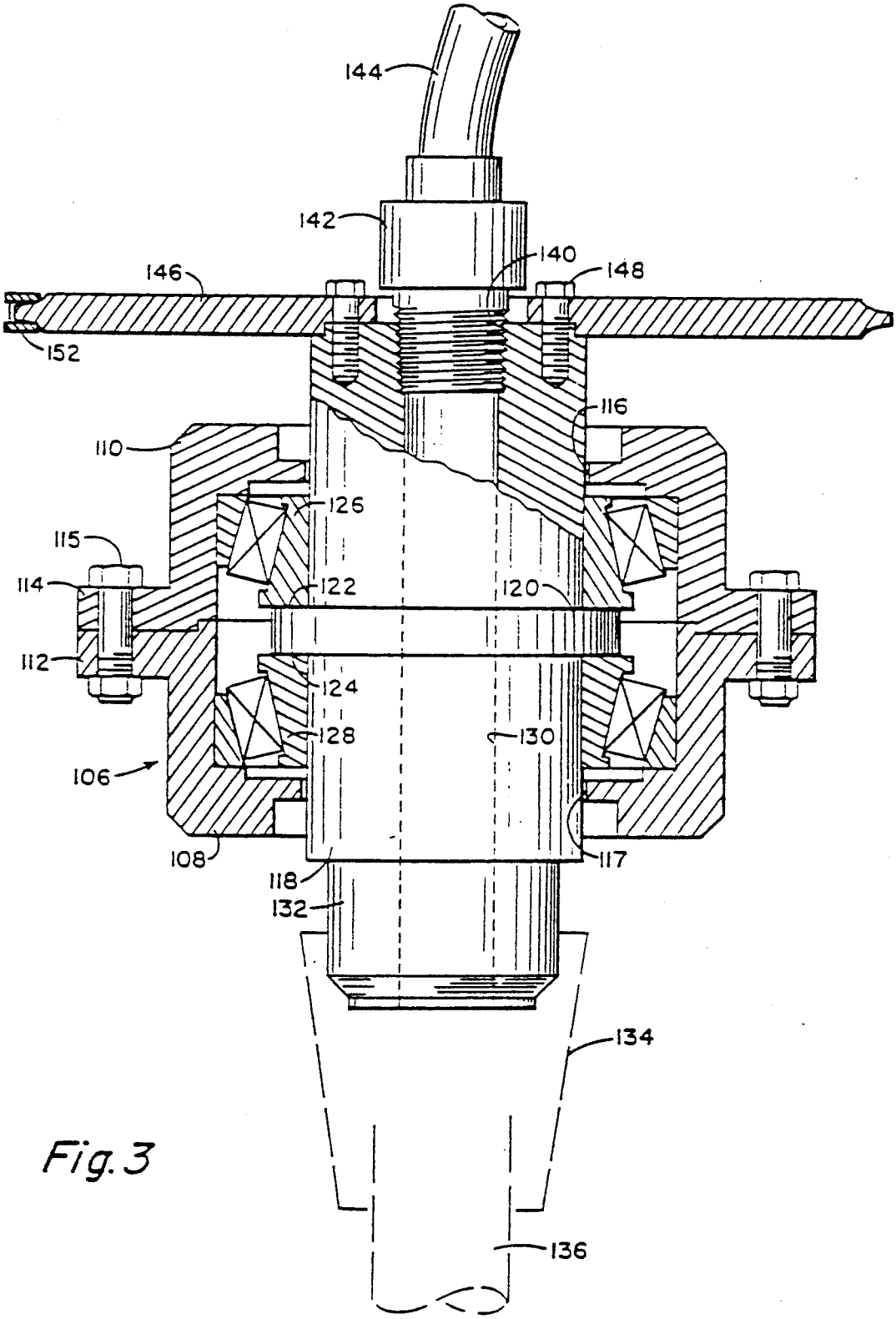
FIG. 3 is an enlarged sectional elevational view of the driving means for a drilling apparatus embodying the invention, with portions shown in elevation for purposes of illustration.

Referring to the drawings in detail, and particularly FIGS. 1, 2 and 3, reference numerals 10 generally indicates a core drilling apparatus comprising a mobile vehicle 12 having a drill assembly 14 provided at the forward end thereof. Whereas the vehicle 12 may be of any suitable type, as shown herein the vehicle comprises a frame or bed portion 16 suitable suspended from a pair of spaced forward wheels 18 and a pair of spaced rear wheels 20. The wheels 18 and 20 are preferably disposed in substantial longitudinal alignment, as is well known, for supporting the vehicle 12 during a drilling operation and for facilitating transporting of the vehicle from one site to another, as is well known. A suitable operator's bench or seat 22 may be mounted on the bed portion, preferably in the proximity of the wheels 20, but not limited thereto. A steering wheel assembly 24 is operable connected with the wheels 218 and/or 20—in a manner as will be hereinafter set forth, whereby the maneuvering of the vehicle may be controlled by the operator disposed in the seat 22.

A suitable power plant 26, such as a gasoline engine or the like, is mounted on the frame or bed portion 16 and is operably connected with a hydraulic pump means 28 through a drive shaft 30 and coupling means 32, is well known. The pump means 28 is operable connected with a plurality of fluid control valves 34 in any suitable manner (not shown) for controlling the circulation of fluid thereto from a fluid reservoir 36 mounted on the bed portion 16. A hydraulic motor 38 is mounted on the bed portion 16 and is in communication with the fluid supply reservoir 36 in any suitable manner (not shown). A sprocket or pulley means 40 is keyed or otherwise secured to the drive shaft 42 of the motor 38 for rotation thereby. A complementary sprocket or pulley member 44 is keyed or otherwise secured around the outer periphery of the axle 46 extending between the wheels 28, and a chain or belt means 48 extends around and between the sprockets 40 and 44 for transmitting rotation therebetween. In addition, a suitable fluid control valve means 50 is mounted on the bed portion 16 in the proximity of the operator's seat 22 and operably connected with the motor 38 for controlling the supply of fluid thereto for operation thereof as will be hereinafter set forth. When the sprocket 44 is rotated by the actuation of the motor 38 and sprocket 40, the axle 46 is rotated about its own longitudinal axis for transmitting rotation to the wheels 18 for a purpose as will be hereinafter set forth.

A second hydraulic motor 52 is mounted on the bed portion 16 and operably connected with the fluid reservoir 36 in any well known manner (not shown) for receiving fluid therefrom through at least one of the valves 34. The drive shaft 54 of the motor 52 is operably connected with a belt and pulley assembly 56 for transmitting rotary motion to a sprocket or pulley 58 through a suitable gear train assembly 60. The assembly 60 is mounted on an A-frame support structure 62, and the sprocket 58 may be supported on the A-frame 62 by suitable bearing means 64. The sprocket 28 is connected with a complementary sprocket pulley 66 through a chain or endless belt 68 for transmitting rotation therebetween as is well known. The sprocket 66 is preferably keyed or otherwise secured to a rotatable shaft 70 having the opposite ends thereof suitably journaled in a pair of spaced brackets or flanges 72, only one of which is shown in FIG. 1. Each bracket 72 is rigidly secured to the bed portion 16 by means of a support structure 74.

Each bracket 72 is rigidly secured to an upstanding elongated I-beam member 76 and 78, respectively. The I-beam members 76 and 78 function as tracks or rails during the reciprocation of a rotary drive table means generally indicated at 80, as will be hereinafter set forth. A first axle or pivot shaft 82 is secured to the lower ends of the tracks 76 and 78 in any well known manner, and spans the distance therebetween as particularly shown in FIG. 2. A second axle or pivot shaft 84 is similarly secured between the upper ends of the tracks 76 and 78 and disposed in substantially parallel relationship with respect to the shaft 82. A first sprocket or gear member 86 is secured on the shaft 82 and substantially centrally disposed between the tracks 76 and 78 in substantial planar alignment with the sprocket 66. A second sprocket or gear member 88 is similarly secured on the shaft 84 and disposed in substantial planar alignment therewith. An endless chain 90 extends around and between the sprockets 86 and 88 and is in engagement with the outer periphery of the sprocket 66 whereby rotation of the sprocket 66 moves the chain 90 linearally between and around the sprockets 86 and 88 for a purpose as will be hereinafter set forth.

The drive assembly 80 comprises a pair of spaced substantially identical T-shaped brackets 92 and 94 loosely secured to the tracks or rails 76 and 78, respectively, by back plates 96 (only one of which is shown in FIG. 1). A cross member 98 is secured between the outer ends of the brackets 92 and 94 and disposed in spaced relation with respect to the outer edges of the rails 76 and 78. A hydraulic motor 100 is secured to the cross member 98 wand in engagement with the chain 90 in any suitable manner (not shown) and operably connected with the hydraulic fluid system in any suitable manner (not shown) for a purpose as will be hereinafter set forth. In addition, a pair of substantially mutually parallel outwardly extending plates or flanges 102 and 104 are welded or otherwise secured to the outer surface of the cross member 98 for receiving and supporting a rotary sealing assembly 106 therebetween.

The rotary sealing assembly 106 comprises a pair of substantially identical oppositely disposed cylindrical housing members 108 and 110 having complementary outwardly extending circumferential flanges 112 and 114, respectively, removably secured together by a plurality of circumferentially spaced bolts 115, as is well known. Each housing 108 and 110 is substantially cup-shaped and the closed ends thereof are provided with bores or apertures 116 and 117, respectively, for receiving a sleeve member 118 therethrough. An outwardly extending circumferential flange 120 is provided around the outer periphery of the sleeve 118 and is disposed within the interior of the coupled housing 108 and 110, as particularly shown in FIG. 3, providing oppositely disposed annular shoulders 122 and 124. A bearing member 126 is disposed around the sleeve 118 within the housing 110 and has the inner race thereof supported on the shoulder 122 and the outer race thereof disposed against the inner periphery of the housing 110 and held in position by the inner surface of the closed end thereof. A second similar bearing 128 is disposed around the sleeve 118 in the housing 108 and has the inner race thereof disposed against the shoulder 124 and the outer race thereof disposed against the inner periphery of the housing 108 and supported by the inner surface of the closed end thereof. In this manner, the sleeve 118 may be freely rotated about its own longitudinal axis independently of any movement of the housing members 108 and 110.

The sleeve 118 is provided with a centrally disposed fluid passageway 130 extending longitudinally therethrough and is preferably provided with a reduced diameter neck portion 132 at the lower end thereof as viewed in the drawings for receiving a suitable coupling member 134 for securing a length of drill pipe 136 thereto. A suitable core drill 138 is secured to the lower end of the drill pipe 136 in the usual manner and for a purpose as will be hereinafter set forth. The upper end of the bore 130 is threaded as shown at 140 for receiving a suitable rotating water coupling member 142 therein. The coupling 142 is carried by or secured to a flexible conduit 144 for directing a suitable fluid into and through the passageway 130 during operation of the apparatus 10, as will be hereinafter set forth. In addition, a sprocket member 146 is rigidly secured to the upper end of the sleeve 118 in any well known manner, such as by a plurality of bolts 148. The sprocket 146 is disposed in substantially planar alignment with a drive sprocket (not shown) secured to the drive shaft 150 of the motor 100, and a chain 152 extends around and between the planar sprockets whereby rotation is transmitted to the sprocket 146 during actuation of the motor 100, thus transmitting rotation to the sleeve 118.

To provide stability for the rails 76 and 78, it is desirable to secure the lower portions thereof to the bed portion 16 by suitable connecting linkages 154 (FIG. 1). In addition, a suitable guide sleeve 156 may be secured in substantial axial alignment with the sleeve 118 for receiving the drill pipe 136 therethrough during a drilling operation. The sleeve or guide 156 may be secured to the rails 76 and 78 by means of a suitable A-frame support means 158 (omitted in FIG. 2 for purposes of illustration).

When the apparatus 10 is utilized for a core drilling operation, the vehicle 12 may be maneuvered into the desired location for positioning of the drill pipe 136 in substantial axial alignment with the location of the bore hole to be drilled. This may be accomplished by the normal operation of the fluid control valve means 50 by the operator (not shown) of the vehicle whereby the motor 38 is activated for transmitting rotation to the front drive wheels 18 through the sprockets 40 and 44 and chain or belt 48. Of course, the vehicle may be steered through the use of the steering wheel means 24 in the usual manner, all as is well known.

When the vehicle 12 has been properly located, the locomotion of the vehicle may be ceased, and the operator may leave the area of the seat 22 and steering wheel means 24, and move to the proximity of the valving mechanism 34 of the usual or normal operation thereof. The motor 52 may be activated by the proper manipulation of the valves 34 whereby the sprockets 58 and 66 are rotated for driving the chain 90 as hereinbefore set forth. Simultaneously the motor 100 may be activated for rotating the sprocket 146 and associated sleeve 118 whereby the drill pipe 136 will be rotated for activation of the core drill 138 to perform a core drilling operation. Of course, a suitable drilling fluid, such as water, is admitted into the interior of the drill pipe through the conduit 144 and passageway 130 for facilitating the drilling operation, as is well known and as will be hereinafter more fully set forth.

Figure 6:
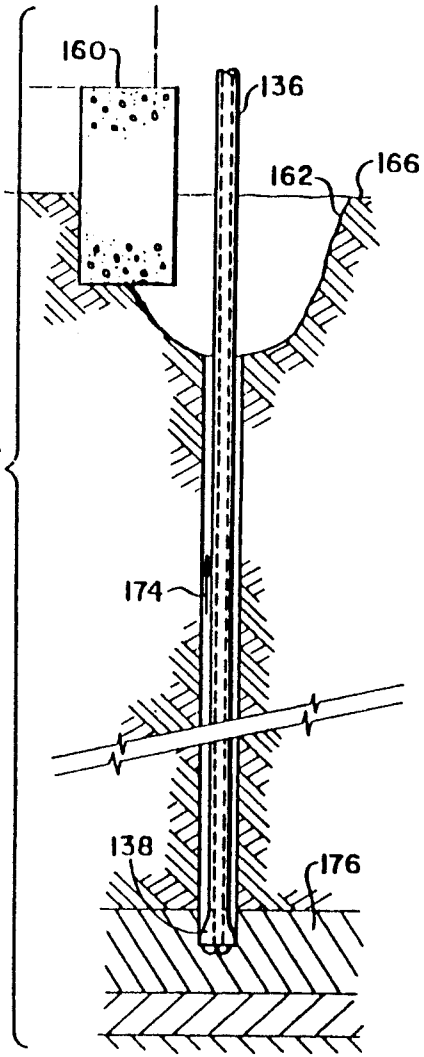
FIGS. 4 through 10 are sectional elevational views illustrating a method of shoring a foundation and which embodies the invention.
Figure 5:
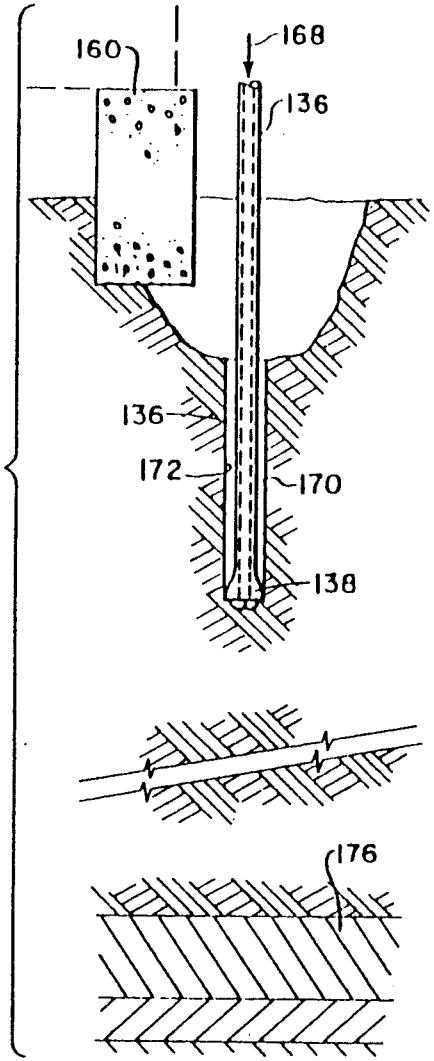
Figure 4:
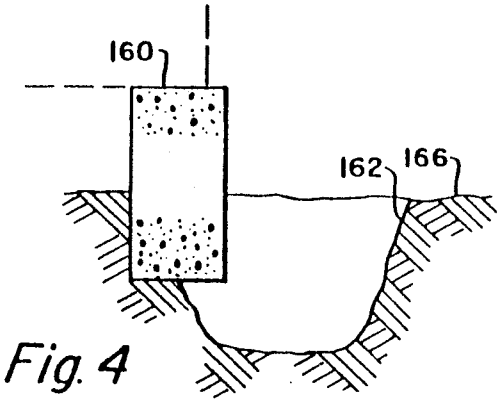

As the chain 90 moves in a direction toward the sprocket 86, the assembly 80 moves simultaneously therewith due to the connection of the motor 100 with the chain. The flanges 92 and 94 and complementary back plates 96 slide longitudinally along the rails 76 and 78 for facilitating the guiding of the downward movement of the apparatus or assembly 80. When the assembly 80 approaches the guide sleeve 156 the movement of the chain 90 in the direction toward the sprocket 86 may be ceased, and the direction of movement thereof reversed whereby the assembly 80, being disconnected from the drill pipe 136, may be elevated in order that an additional section of drill pipe may be added to the upper end of the pipe 136 for increasing the overall length thereof. The chain 90 may then again be moved in the direction toward the sprocket 86 for continuing the well bore drilling operation until the bore hole is excavated in any well known manner in the proximity of the foundation 160 for exposing at least a portion thereof as shown in FIG. 4. The vehicle 12 may then be maneuvered in such a manner as to position the drill pipe 136 and core drill 138 in spaced relation with respect to the foundation 160, and in alignment with the hole 162. The operation of the drill pipe and core drill may be initiated in the usual manner for a well bore drilling operation, and the guide sleeve 156 guides the drill pipe 136 as the drilling operation continues at the location of the hole 162. As the core drill 138 penetrates the earth, as particularly shown in FIGS. 5 and 6, water or other suitable drilling fluid is directed longitudinally downwardly through the drill pipe 136 as indicated by the arrow 168. The down flowing water stream emerges from the core drill 138 at the bottom thereof and flows upwardly through the annulus 170 between the drill pipe and inner periphery of the bore hole 172, as indicated by the arrow 174. The water moving upwardly through the annulus 170 washes the cuttings of the core drill from the bottom of the bore 172 to the surface 166 of the earth, as is well known in core drilling operations. The cuttings may be recovered at the surface 166 and may be periodically sampled in order to make a definite determination of the formation through which the core drill 138 is moving during the drilling operation.

When the bore hole 172 has been drilled to a sufficiently great depth that the core drill 138 reaches the actual bedrock formation 176 and penetrates the formation 176, the cuttings from the formation 176 will be washed to the surface 166. As these cuttings reach the surface 166, they may be properly analyzed for ascertaining that the core drill 138 has, indeed, penetrated the actual bedrock formation, whereupon the drilling operation may be ceased and it may be desirable to retrieve the core sample for visual inspection and analysis. It is to be understood that geological information is readily available in substantially every portion of the United States providing information as to the identity of the bedrock formation for the area, thus the sampling of the cuttings from the core drilling operation will provide a positive determination of the penetration of the bedrock formation of the area.

Figure 7:
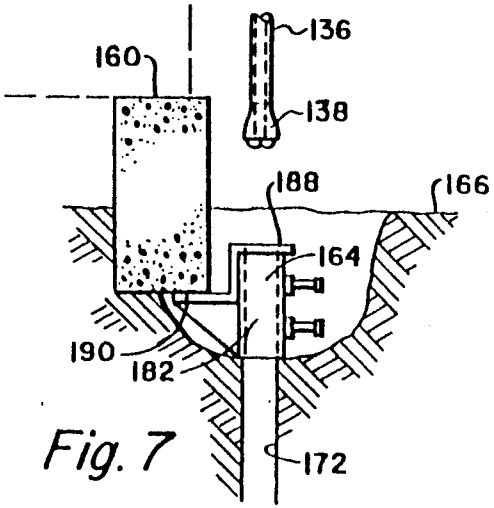
Figure 10:
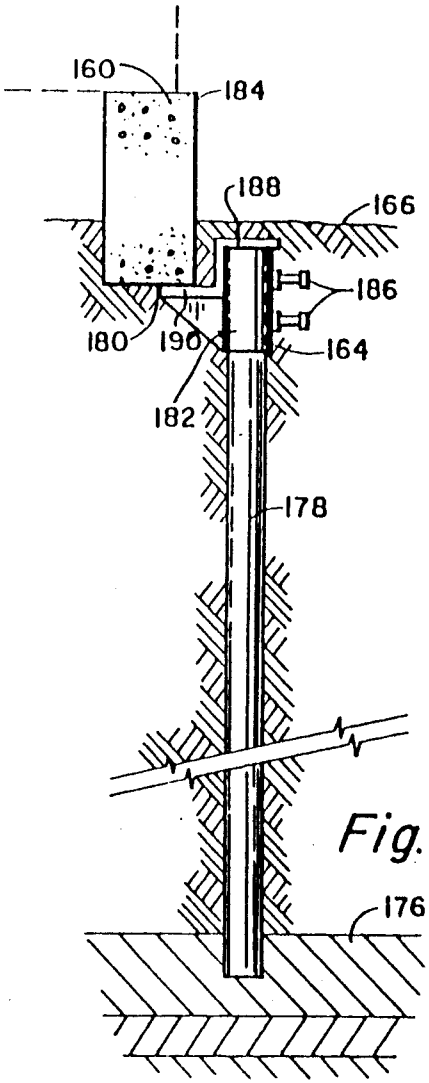
Figure 11:
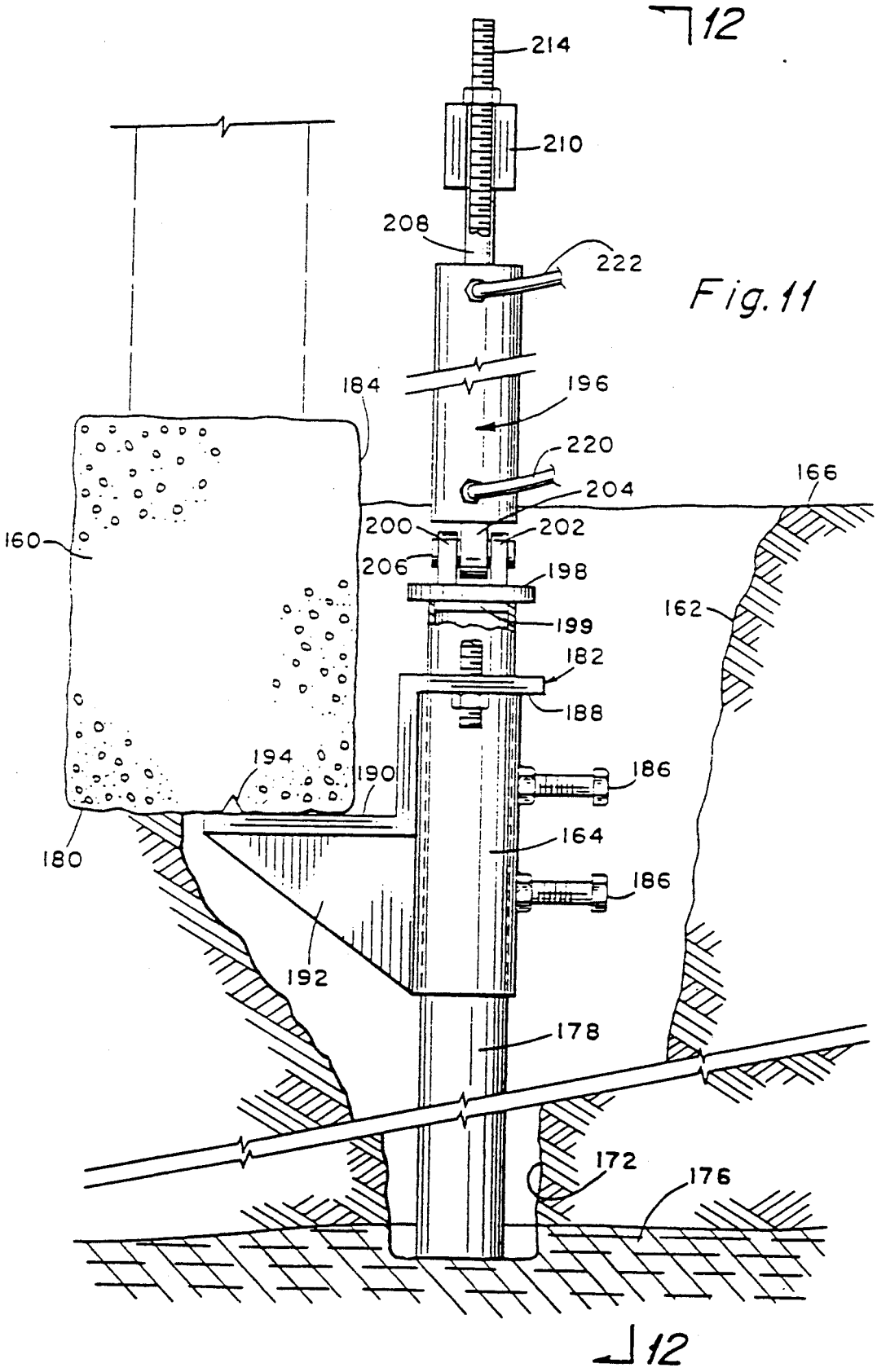
FIG. 11 is an enlarged sectional elevational view of a supporting and jacking means for a building foundation and which embodies the invention, with portions shown in elevation for purposes of illustration.
Figure 12:
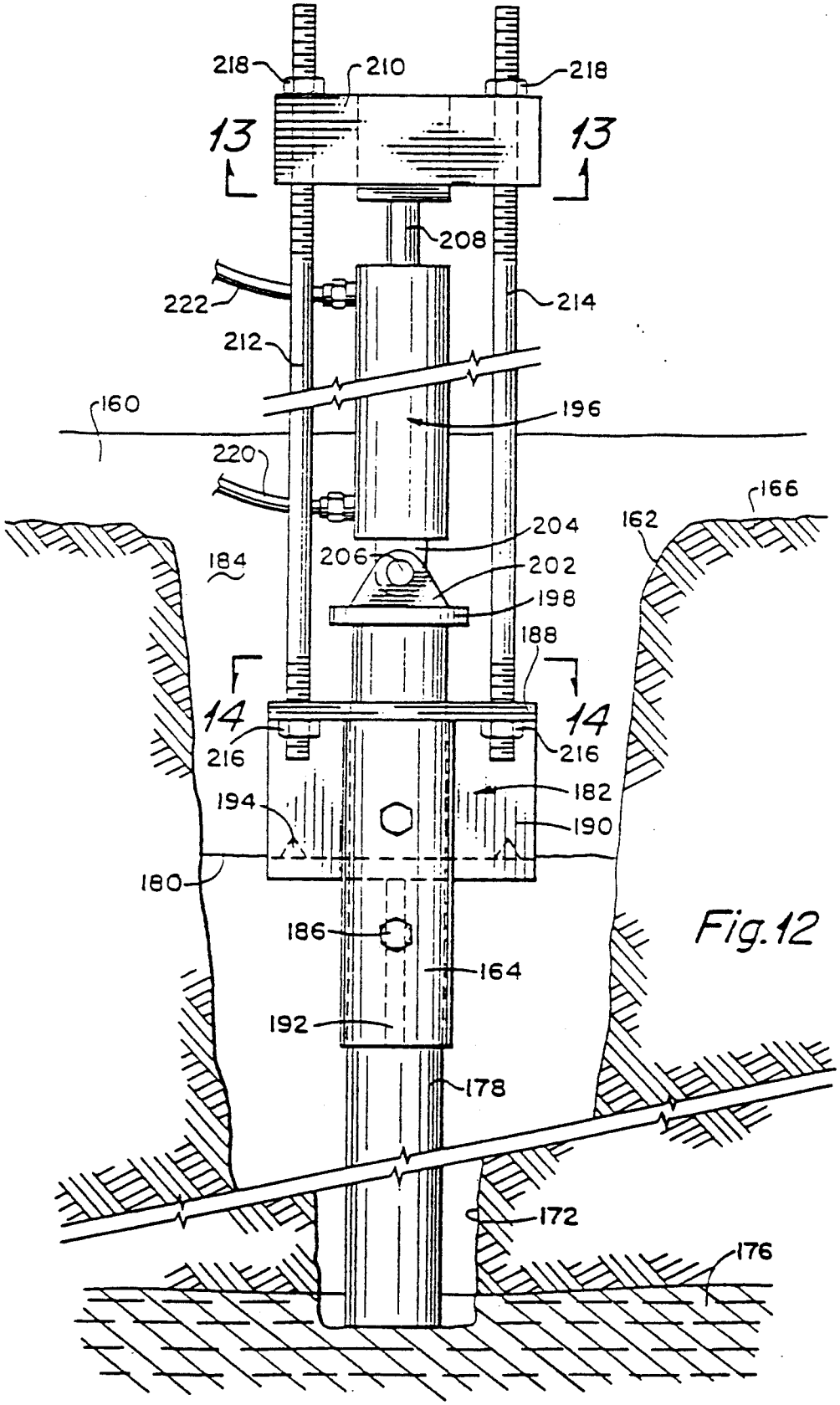
FIG. 12 is a view taken on line 12—12 of FIG. 11.

At this time, the drill pipe 136 and core drill 138 may be removed from the bore 172 in the usual manner. A suitable casing 164 may then be installed in the hole 162 in substantial alignment with the bore 162, as particularly shown in FIG. 7. The casing 164 is positioned in such a manner that the upper end thereof is disposed lower than the surface 166 for a purpose as will be hereinafter set forth. In addition, a foundation support apparatus 182 (more particularly shown in FIGS. 11 and 12) is secured to the outer periphery of the casing 164 and is movable longitudinally thereof for engagement with the lower portion 180 of the foundation 160.

Figure 9:
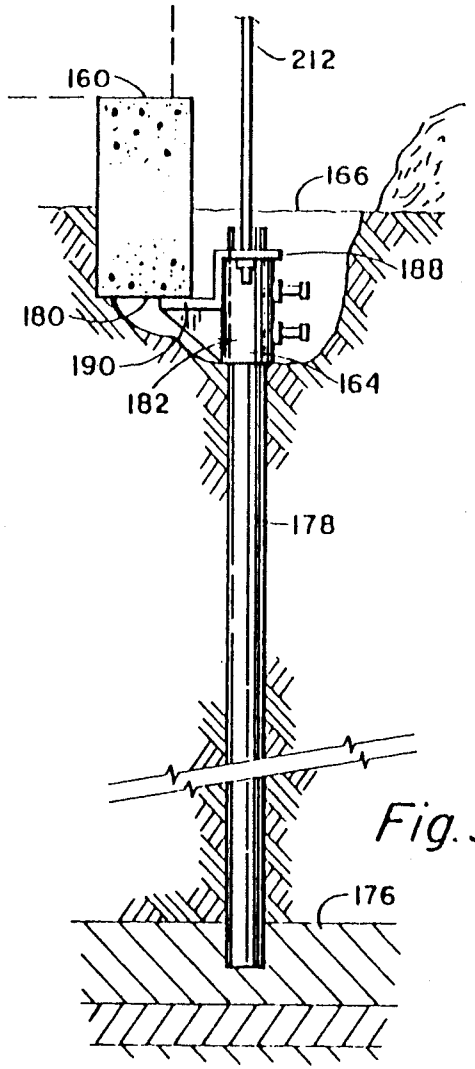
Figure 8:
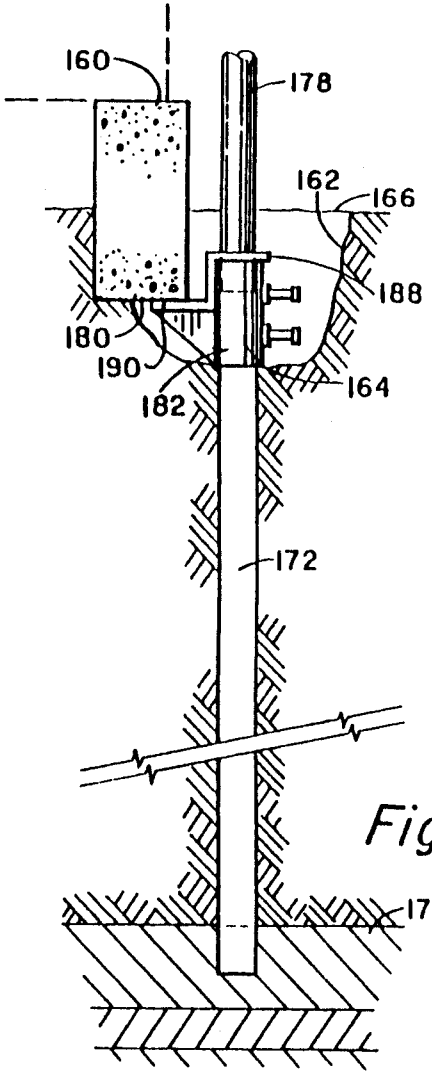

When the drill pipe 136 and core drill 138 have been removed from the bore hole 172 a pipe or piling member 178 may then be installed in the bore 172, with the lowermost end of the piling 178 (which may be in the form a well casing member) ultimately resting on or embedded within the actual bedrock formation 176, as shown in FIGS. 9, 10, 11 and 12. Of course, the piling or casing 178 may be set in the bore 172 prior to the installation of the casing 164 therearound, or the piling 178 may be inserted through the casing 164 whereby the casing 164 functions as a guide for the installation of the piling as shown in FIGS. 8 and 9, as desired. In any event, the casing 164 is secured around the outer periphery of the piling or casing 178 in any suitable manner, such as by a plurality of bolts 186 which not only secures the casing 164 to the piling 178, but also secures the foundation support apparatus 182 to the casing 164.

As hereinbefore set forth, the foundation support apparatus 182 is movable longitudinally simultaneously with the casing 164 for positioning thereof in such a manner that the under surface 180 of the foundation 160 is engaged thereby. It is preferable that the apparatus 182 be spaced slightly from the outer surface 184 of the foundation 160, but not limited thereto. The foundation support apparatus 182 may be of any suitable construction, and as shown herein comprises a plate 188 welded or otherwise rigidly secured to the upper end of the casing 164 and integral with or secured to a substantially L-shaped bracket member 190. One leg of the L-shaped bracket member 190 preferably engages the outer periphery of the casing 164 and may be welded or otherwise secured thereto, and the other leg of the bracket 190 extends substantially perpendicularly outwardly therefrom for engagement with the under surface 180 of the foundation 160. A suitable gusset 192 is welded or otherwise secured between the outwardly extending leg of the bracket 190 and the outer periphery of the casing 164. It is preferable to provide a plurality of outwardly projecting prong members 194 on the upper surface of the outwardly extending leg of the bracket 190. The prong members 194 being provided for a slight embedding in the under surface 180 of the footing or foundation 160 for facilitating the engagement of the bracket 190 therewith. It will be apparent that the engagement of the bracket member 190 with the foundation 160 will support the foundation 160 from the actual bedrock formation 176 by virtue of the connection between the foundation support 182, casing 164 and piling 178.

It may be desirable or necessary to "jack up" the foundation 160 somewhat prior to a final step of backfilling the hole 162. In that event, a suitable hydraulic jack apparatus generally indicated at 196 may be suitably secured to the upper end of the casing or piling 178 by means of a support plate 198 removably secured to the upper end of the casing 178. A boss or pipe 199 of an outer diameter smaller than the inner diameter of the piling 178 is secured to the outer face of the plate 198 for insertion within the piling 178 for facilitating securing of the jack 196 to the piling. A pair of spaced flanges 200 and 202 extend upwardly from the inner surface of the plate 198 for receiving a flange 204 of the jack 196 therebetween and the flange 204 may be welded or otherwise secured to the flanges 200 and 204 for securing the jack apparatus 196 to the upper end of the piling 178. The piston rod 208 of the jack 196 is suitably secured to a cross member 210 for reciprocal movement thereof. The cross member 210 is secured to the plate 188 by a pair of spaced elongated rods 212 and 214 as particularly shown in FIGS. 11 and 12. The opposite ends of the rods 212 and 214 are threaded for engagement with the plate 188 and cross member 210. Suitable lock nuts 216 are secured to the rods 212 and 214 against the underside of the plate 188, and similar lock nuts 218 are secured to the rods 212 and 214 against the outer surface of the cross member 210, thus securing the rods to and between the plate 118 and cross member 210.

Figure 15:
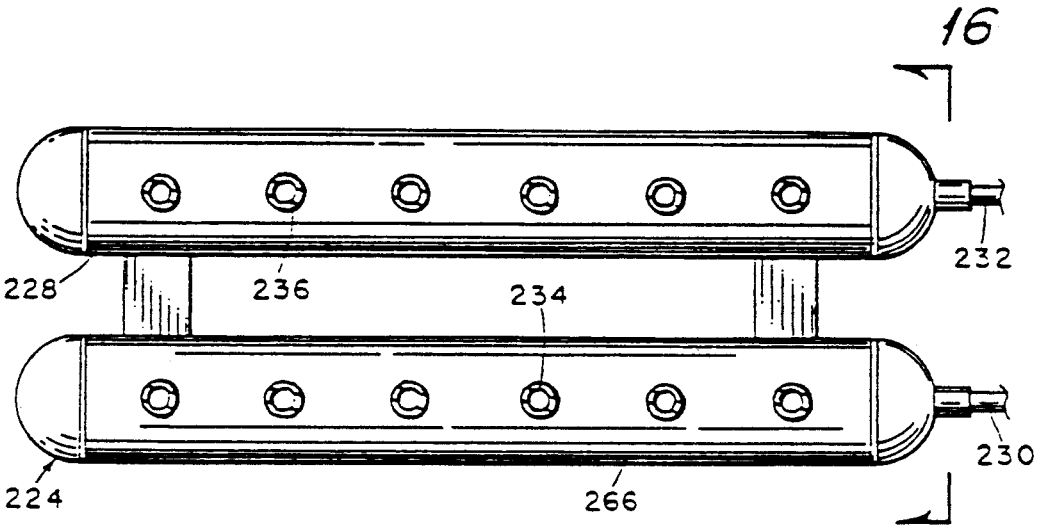
FIG. 15 is a plan view of a manifold utilized in combination with a jacking means embodying the invention, and is taken on line 15—15 of FIG. 16.
Figure 14:
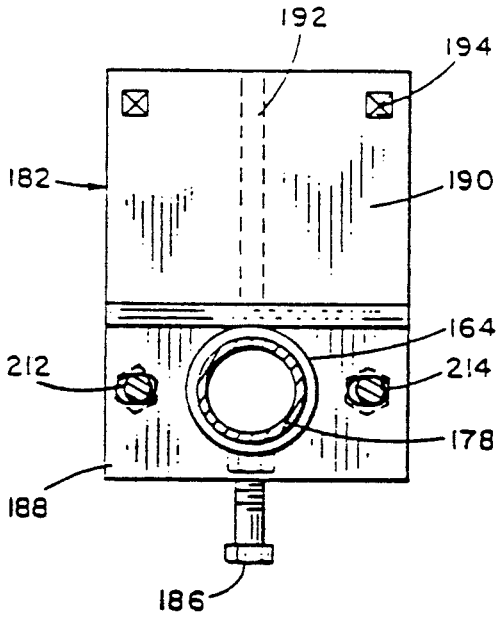
FIG. 14 is a view taken on line 14—14 of FIG. 12.
Figure 16:
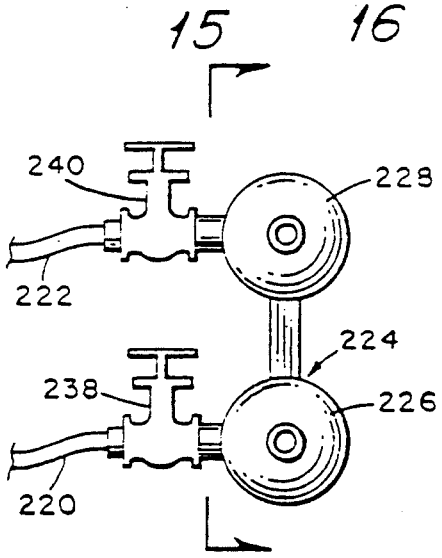
FIG. 16 is a view taken on line 16—16 of FIG. 15.
Figure 13:
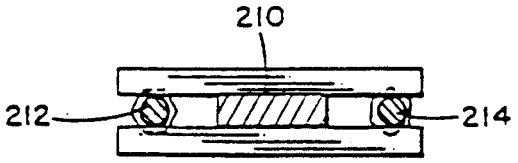
FIG. 13 is a view taken on line 13—13 of FIG. 12.

Suitable fluid lines or conduits 220 and 222 are in communication with the cylinder 224 of the jack 196 for directing actuating fluid to and from the opposite ends of the cylinder for reciprocation of the piston rod 208, as is well known. The conduits 220 and 222 are in communication with a fluid source through a manifold 224 (FIGS. 15 and 16) which may be installed on the vehicle 10, or may be completely independent, as desired.

The manifold 224 preferably comprises a pair of spaced fluid banks 226 and 228, with the fluid bank 226 being in communication with a fluid source through a conduit 230 and the fluid bank 228 being in communication with a fluid source through a conduit 232. Of course, the fluid sources may be a common source, or independent sources. The fluid bank 226 is preferably provided with a plurality of spaced fluid ports 234 and the fluid bank 228 is preferably provided with a plurality of spaced fluid ports 236. In this manner, the manifold 224 may be utilized for providing fluid to and withdrawing fluid from a plurality of jack assemblies 196 for a purpose as will be hereinafter set forth. The conduits 220 of the jack assembly 196 is in operable connection with one of the fluid banks, such as the bank 226, and the conduit 222 is similar in operable connection with the other fluid bank 228. In addition, a suitable on-off valve 238 is interposed in the conduit 220 between the fluid bank 226 and the jack 196, and a similar on-off valve 240 is interposed in the conduit 222 between the fluid bank 228 and the jack 196 in order that either or both of the conduits 220 and 222 may be isolated from the fluid source if desired.

In the event it is necessary or desirable to slightly elevate or lift the foundation 160 at the location of the engagement thereof with the foundation support apparatus 182, a suitable fluid may be admitted into the jack assembly 196 through the conduit 220 for applying a lifting force against the piston rod 208 and simultaneously fluid is withdrawn from the jack or cylinder through the conduit 222. As the piston rod 208 is extended due to the force of the pressure entering the jack through the conduit 220, the cross member 210 is moved upwardly with respect to the piling 178. The upward movement of the cross member 210 is transmitted to the foundation engaging apparatus 182 through the rods 212 and 214 whereby the bracket 190 exerts an upward force on the under surface 180 of the foundation 160.

To load test individual piers, all of the valves 238 are closed except the valve in line 220 connected to the pier which is being tested. When pressure in line 220 to the pier being tested reaches a predetermined limit, for example, 4,000 psi if the final support pressure is to be 1,000 psi, the valve is closed. Each pier is similarly tested. After each pier has been individually load tested, individual valves 238 are actuated for controllably elevating portions of the foundation until each portion of the foundation is raised to a predetermined elevation.

All of the valves 238 are then opened causing the plurality of cylinders 196 to be connected in parallel through supply conduits 220 so that the force on each pier 178 supporting a portion 160 of the foundation will each exert substantially the same uplift force since pressure in all of the cylinders is allowed to equalize.

When the foundation 160 has been elevated through the desired distance, the supply of fluid to the jack through the conduit 220 may be ceased, and the casing 164 may be secured in position on the casing or piling 178 by the bolts 186 or by welding pier 178 to bracket casing 164. The jack apparatus 196 may then be removed from connection with the piling 178 and foundation engaging apparatus 182, whereupon the bore or hole 162 may be filled in the usual or well known manner for completely encasing the foundation, piling 178 and casing 164 and restoring the surface 166 of the earth to its original condition.

It is to be noted that a plurality of drilling operations as hereinbefore set forth may take place in the proximity of the foundation 160 as required for restoring the entire foundation to its original elevation. Subsequent to setting a plurality of the foundation supporting structures 182 in engagement with the under surface 180 of the foundation 160, each of the respective piling members 178 may be operably connected with a jack apparatus 196 and each of the jacks 196 may be operably secured to the manifold 224 in the manner as hereinbefore set forth. All of the jacks 196 may be activated simultaneously to easily and slightly elevate the foundation 160 in a manner for reducing any excess strain at a single position on the foundation. In addition, any of the positions which do not require any additional elevation may be isolated from the fluid source through the manifold by closing of the respective on-off valves 238 and 240. Of course, the operation may be repeated around the outer periphery of the foundation 160 as required for an adequate shoring thereof.

SECOND EMBODIMENT

Detailed Description of Preferred Embodiments

Figure 17:
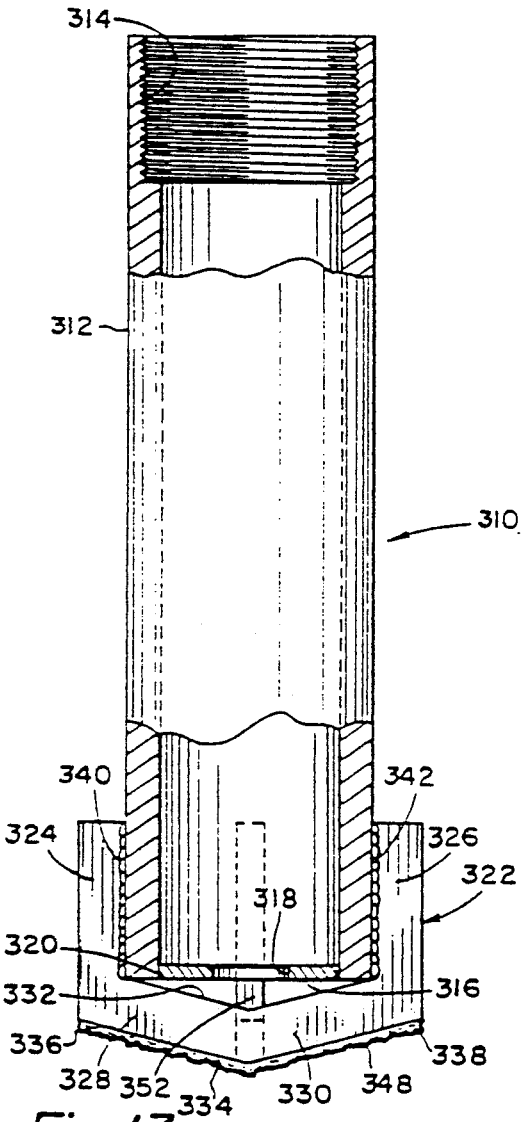
FIG. 17 is an elevational view of a drill bit, shown partly in cross-section, constructed in accordance with the instant invention.

Indicated generally at 310 in FIG. 17 is a drill bit constructed in accordance with a second embodiment of the instant invention. A pipe 312 includes a set of internal threads 314 cut therein at the upper end of the pipe. The lower end of the pipe includes a washer 316, having the usual hole 318 centered therein, welded across the inner diameter of the pipe at the lower end thereof. The washer is welded via a weld 320 at its outer circumference to the radially inner surface of the pipe.

A plate or bit member 322 includes a pair of substantially parallel legs 324, 326 and a pair of cutting element supports 328, 330. The edges of legs 324, 326 and of cutting element supports 328, 330 which are directed toward pipe 312 define a substantially U-shaped notch 332. Bit member 322 includes a raised central portion 334 and a pair of lower outer portions 336, 338. These central and outer portions are formed on the lower edge of the bit member. The bit member is welded to the radially outer surface of pipe 312 via welds 340, 342, 344, 346. Tungsten carbide 348 is welded on the lower edge of bit member 322 with a brass and nickel compound. Tungsten carbide covers the entire lower edge of bit member 322 and presents a downwardly facing roughened surface which, as will later be described, cuts into earth and rock during drilling.

Additional bit members 350, 352, similar to bit member 322, are mounted on pipe 312 and drill bit member 322. Bit member 352 is welded via welds 354, 356 to one side of bit member 322 and by welds 358, 360 to the radially outer surface of pipe 312. Bit member 350 is welded in a similar fashion to the radially outer surface of the pipe and to the other side of bit member 322, via welds as shown. Each bit member 350, 352 includes a lower outer portion, like lower outer portion 364 on bit member 350, which is at substantially the same level as lower portions 336, 338 on bit member 322. The lower edge of each bit member 350, 52 is coated with tungsten carbide in the same fashion that bit member 322 is coated.

Figure 19:
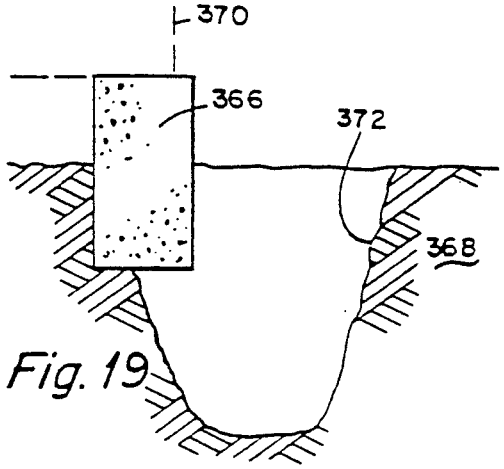
FIG. 19 is an elevational view of a building foundation having a hole excavated in the earth adjacent thereto.

Turning now to FIG. 19, a conventional concrete building foundation 366 is partially buried in earth 368 as shown. Foundation 366 supports a building 370 which has settled downwardly thus stressing and forming cracks in the building. A hole 372 is excavated adjacent foundation 366 at a location at which shoring up of the foundation is needed.

Figure 20:
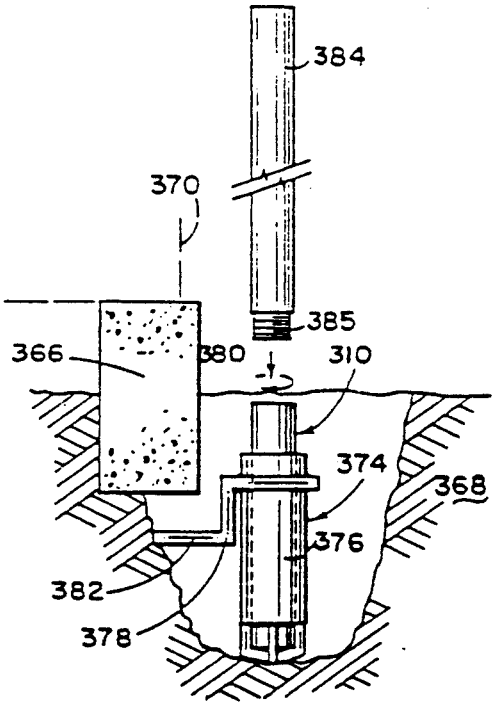
FIGS. 20–23 are views similar to FIG. 19 showing the installation of the apparatus of the instant invention.

Turning now to FIG. 20, indicated generally at 374 is a fitting. The fitting includes a tubular portion 376 which in the view of FIG. 20 has pipe 312 received therethrough. A bracket 378 is welded to tubular portion 376 via welds, like weld 380, as shown. The bracket includes a lateral portion 382 which extends outwardly at a substantially ninety-degree angle from the axis of tubular portion 376. Fitting 374 is more fully described in applicant's copending application Ser. No. 762,800. A pipe 384 includes a set of threads 385 formed on the radially outer surface at the lower end thereof. The upper end of the pipe includes a set of threads (not visible) formed on the radially inner surface thereof, like threads 314 are formed on the inner surface of pipe 312 in FIG. 17.

Figure 21:
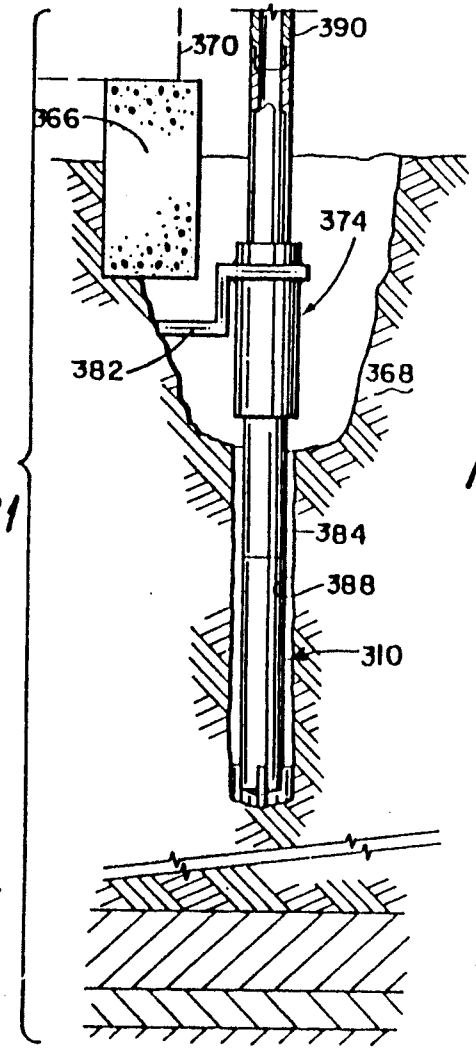

In using the apparatus of the instant invention, a hole, like hole 372, is first excavated adjacent foundation 366 at a location at which the foundation needs to be raised and supported at a selected higher level. Thereafter, drill bit 310 is slid within tubular portion 376 of fitting 374 and is position in hole 372 as shown in FIG. 20. Next, pipe 384 is threadedly engaged with pipe 312 via threads 385, 314. A conventional portable drilling apparatus is connected to pipe 384 in the usual manner to apply downward pressure and to rotate bit 310, thus drilling a bore 388 in FIG. 21.

During drilling, a source of compressed air is connected to the top of pipe 384 to provide pressurized air into bit 310 and through hole 318 into the bore. Such serves as a circulating fluid which blows cuttings away from the bottom of the bit during drilling and upwardly in the annulus between pipe 310 and bore 388 to the surface of the bore.

As drilling progresses, the upper end of pipe 384 approaches earth 368. At approximately the position shown in FIG. 21, the drilling apparatus is disconnected from pipe 384. Next an additional pipe 390 which includes a set of threads formed on the radially outer surface at the lower end thereof is threadably engaged with the threads (not visible at the upper end of pipe 384.

Figure 22:
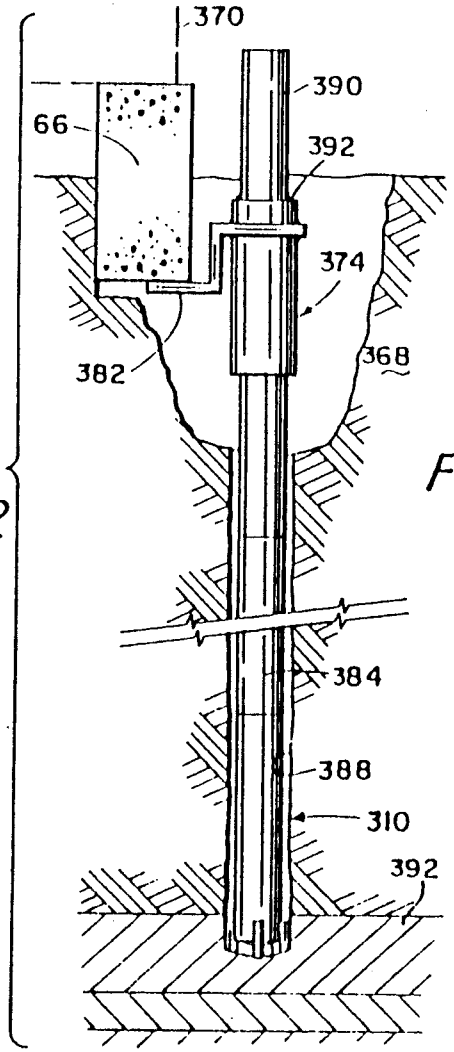

Thereafter, the drilling apparatus is connected to pipe 390. Rotary motion and downward force is applied to pipe 390, compressed air is circulated therethrough, and drilling proceeds as shown in FIG. 22. As drilling progresses, additional threaded pipes may be connected to the uppermost pipe extending from the ground thereby enabling drilling until a suitable rock formation is reached. The cuttings which are blown to the surface of bore 388 by the circulating fluid may be examined to determine when bit 310 has bored into a suitable rock formation, like rock formation 392. When such occurs, drilling is stopped and the drilling apparatus is disconnected from the uppermost pipe.

If the foundation to be raised up and the load supported thereby is particularly heavy, it may be desirable at this stage to inject grout into the uppermost pipe, like pipe 390 in FIG. 22. When pipes 312, 384, 390 are filled with hardened grout, the pipe can support a greater load than if no grout were added. The grout reinforces the pipe at each threaded connection, the point at which failure is likely when the pipe string is compressed under a heavy load. It should be appreciated that most shoring operations will not require the addition of grout in the pipe string.

Figure 23:
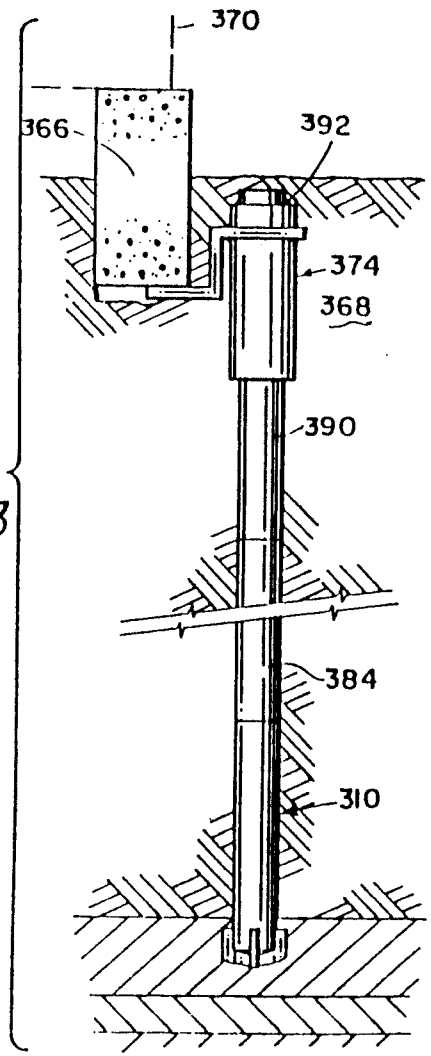

When drill bit 310 is in the position shown in FIG. 22 and drilling is stopped, lateral portion 382 of fitting 374 is positioned as shown in FIG. 22 with the lateral portion being beneath foundation 366. Thereafter, fitting 374 is urged upwardly relative to pipe 390. In the instant embodiment of the invention such urging is under action of a hydraulic ram (not shown) mounted on the top of pipe 390 and connected to bracket 374 as disclosed in co-pending application Ser. No. 762,800. When fitting 374 is raised to reposition the foundation by a suitable amount, the fitting is fixedly attached to pipe 390. In the instant embodiment of the invention the fitting is welded to the pipe via a weld 392. After the fitting is so secured, the hydraulic ram is removed and pipe 390 is cut off just above fitting 374. Hole 372 is then filled in so that the apparatus assumes the configuration shown in FIG. 23.

Figure 18:
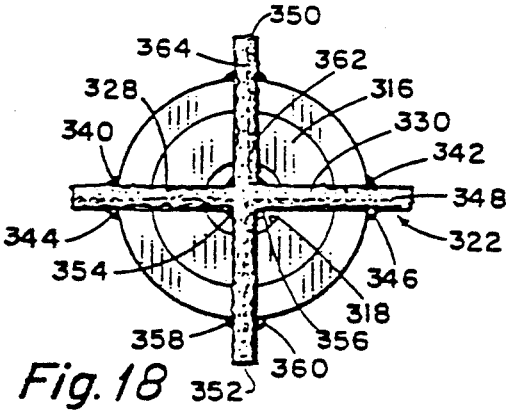
FIG. 18 is a bottom plan view of the drill bit of FIG. 1.

In making drill bit 310, washer 316 is welded to the inner surface of pipe 312 at one end thereof as shown in FIGS. 17 and 18. Bit member 322 is stamped from a substantially planar sheet of metal and is welded via welds 340, 342, 344, 346 to the outer surface of pipe 312 as shown in FIGS. 17 and 18. Bit members 350, 352 are each likewise stamped from a planar piece of metal having substantially the same thickness as the metal from which bit member 322 is cut. Bit member 352 is welded to the outer surface of pipe 312 via welds 358, 360 and to one side of bit member 322 via welds 354, 356. Bit member 350 is welded, opposite bit member 352, to the other side of bit member 322 and to the outer surface of pipe 312 in the same fashion. Thereafter, tungsten carbide is applied to the lower edges of each of the bit members as shown in FIGS. 17 and 18.

Because of the ever changing soil formations from one location to another, load testing the pier into a non-expansive and non-contractive formation has solved the existing problem of achieving the load bearing capability required.

From the foregoing it will be apparent that the present invention provides a novel method and means for shoring a building foundation or footing which assures that the foundation will be supported from the actual bedrock. At least one bore hole is provided in the proximity of the foundation for receiving a piling member therein. The bore hole is drilled by means of a core drilling operation wherein the core samples are reviewed in order to assure that the bore hole is drilled into the actual bedrock formation prior to the setting of the piling member. A support bracket is rigidly secured between the piling and the bottom of the building foundation for efficiently supporting the foundation from the bedrock formation. In addition, in instances wherein it is desirable to actually elevate the foundation at least slightly, fluid jack devices are provided for applying an elevating force simultaneously or independently to selected positions of the foundation for urging the foundation upwardly in a manner substantially precluding damage to the foundation.

While the present invention has been described in particular relation to the drawings attached hereto, it should be understood that other and further modifications, apart from those shown or suggested herein, may be made within the spirit and scope of this invention.

What is claimed is:

1. Apparatus for shoring a building foundation comprising: bore drilling means movable for deposition in the proximity of the foundation for drilling a plurality of spaced bore holes adjacent the edge of the foundation and extending from the surface of the ground to a substratum believed capable of supporting a portion of the foundation weight; piling means disposed within each of said bore holes such that the lowermost ends of said pilings rest on and are supported by said sub-stratum and such that frictional force between adjacent surfaces of said pilings and the sides of said bore holes is substantially nil; a plurality of support bracket means engageable with the lower portion of the foundation; a plurality of fluid pressure actuated jack means each connectable between one of said support bracket means and one of said spaced piling means, said jack means being adapted to individually load test each of said piling means by application of force exceeding the portion of the weight of the foundation which will be supported by said individual piling means and to distribute the portion of the weight of the foundation to be supported by each piling means and connecting means to rigidly secure each support bracket means to one of said piling means whereby a portion of the weight of the foundation is supported from said sub-stratum directly through each piling means and said bracket secured thereto; and load equalizing means comprising: common manifold means connected to the fluid inputs of said plurality of jack means; and common manifold means connected to the fluid outlets of said plurality of jack means.

2. Apparatus as set forth in claim 1 wherein the bore drilling means comprises mobile vehicle means, rotary drilling head means mounted on the vehicle means, drill pipe means secured to the drilling head means for rotation thereby, bore drill means secured to the lower most end of the drill pipe means for drilling of a bore hole, vertically reciprocal means mounted on the vehicle and operably connected with the drilling head means for providing vertical upward and downward movement for the drilling head means during the drilling operation, and means connected with the drilling head means for directing a fluid longitudinally downwardly through the drill pipe means and longitudinally upward through the bore hole for the removal of cuttings during the drilling operation.

3. Apparatus as set forth in claim 2 wherein the vertically reciprocal means comprises a pair of substantially mutually parallel rail members secured to the vehicle and spaced outward therefrom, drive sprocket means mounted on the vehicle and substantially centrally disposed between the rail members, a pair of spaced sprockets jounaled between the rail members in substantially coplanar relationship with respect to the drive sprocket means but axially offset with respect thereto, chain means extending around and between the spaced sprockets and in driving engagement with the drive sprocket for vertical movement upon rotation of the drive sprocket.

4. Apparatus as set forth in claim 3 and including bracket means provided on the drilling head means and loosely engageable with the rail means for guiding the vertical movement of the drilling head means during movement of the chain means.

5. Apparatus as set forth in claim 2 wherein the rotary drilling head means comprises central sleeve means having an internal passageway extending longitudinally therethrough, sectional housing means secured around the outer periphery of the sleeve means, bearing means interposed between the sleeve means and housing means whereby the sleeve means may rotate freely with respect to the housing means, coupling means provided at one end of the sleeve means for securing the drill pipe means thereto, and rotatable sprocket means secured to the opposite end of the sleeve means for transmitting rotation thereto.

6. Apparatus as set forth in claim 5 and including rotating fluid coupling means secured to said opposite end of the sleeve means for admitting fluid into the internal passageway thereof.

7. Apparatus for shoring a building foundation comprising: a source of fluid; a hollow second pipe being threadably engageable with the upper end of a hollow first pipe, and further being adapted for engagement with a source of rotary motion for drilling a bore hole adjacent the foundation; a plurality of additional hollow pipes, each being threadably engageable with said second pipe and with one another and further being adapted for engagement with a source of rotary motion for drilling such a bore hole until a subsurface rock formation is encountered; means connecting said source of fluid to circulate fluid to remove soil cuttings from the bore hole to indicate when a subsurface rock formation is encountered; a fitting receivable over said pipes to form a pipe and fitting combination, said fitting being adapted for engagement with a downwardly directed portion of the foundation; a plurality of like pipe and fitting combinations similarly engaging other parts of the foundation; means for urging said fitting upwardly relative to said pipes; means to equalize the portion of the weight of the foundation between said pipe and fitting combination and said plurality of like pipe and fitting combinations after the foundation has been lifted and supported on said combination and said plurality of like combinations; and means for fixing the fitting in each combination and like combination to one of the pipes in the same combination.

8. The apparatus as set forth in claim 7, wherein said means for urging said fitting upwardly with respect to said pipes comprises: a plurality of hydraulic jack means; and wherein said plurality of means to equalize comprises: a common manifold means connected to the fluid inputs of said plurality of jack means; and common manifold means connected to the fluid outlets of said plurality of jack means.

* * * * *